US009412356B1

(12) United States Patent
Baker et al.

(10) Patent No.: US 9,412,356 B1
(45) Date of Patent: Aug. 9, 2016

(54) APPARATUS AND METHOD FOR NON-OCCLUDED ACTIVE NOISE SHAPING

(71) Applicant: Doppler Labs, Inc., San Francisco, CA (US)

(72) Inventors: Jeff Baker, Newbury Park, CA (US); Dan Wiggins, Montecito, CA (US); Anthony Parks, Queens, NY (US); Thomas Ezekiel Burgess, North Hollywood, CA (US); Matthew Fumio Yamamoto, Moorpark, CA (US); Sal Garcia, Camarillo, CA (US); Chris Caronna, Ventura, CA (US); James Dexter Tickle, Moorpark, CA (US)

(73) Assignee: Doppler Labs, Inc., San Francisco, CA (US)

( * ) Notice: Subject to any disclaimer, the term of this patent is extended or adjusted under 35 U.S.C. 154(b) by 0 days.

(21) Appl. No.: 15/018,574

(22) Filed: Feb. 8, 2016

Related U.S. Application Data

(60) Provisional application No. 62/113,977, filed on Feb. 9, 2015.

(51) Int. Cl.

| | |
|---|---|
| ***H04R 1/10*** | (2006.01) |
| ***G10K 11/178*** | (2006.01) |
| ***H04R 1/28*** | (2006.01) |
| ***H04R 3/04*** | (2006.01) |

(52) U.S. Cl.
CPC ..... *G10K 11/1788* (2013.01); *H04R 1/1016* (2013.01); *H04R 1/1083* (2013.01); *H04R 1/2853* (2013.01); *H04R 3/04* (2013.01); *H04R 2420/01* (2013.01); *H04R 2460/01* (2013.01); *H04R 2460/09* (2013.01)

(58) Field of Classification Search
CPC ..... H04R 5/033; H04R 5/04; H04R 1/1016; G10K 11/1788; G10K 11/178; G10K 2210/1081
See application file for complete search history.

(56) References Cited

U.S. PATENT DOCUMENTS

| | | | | | |
|---|---|---|---|---|---|
| 4,852,177 | A * | 7/1989 | Ambrose | H04R 1/1016 | 181/135 |
| 5,984,045 | A * | 11/1999 | Maeda | F01N 1/02 | 181/254 |
| 6,516,076 | B1 * | 2/2003 | Marlin | G10K 11/004 | 181/159 |
| 2002/0080990 | A1 * | 6/2002 | Lin | H04R 1/1016 | 381/380 |
| 2012/0195440 | A1 * | 8/2012 | Yamagishi | H04R 1/2857 | 381/74 |
| 2013/0315431 | A1 * | 11/2013 | Grinker | H04R 1/1016 | 381/380 |

* cited by examiner

*Primary Examiner* — Simon Sing
(74) *Attorney, Agent, or Firm* — Van Pelt, Yi & James LLP

(57) ABSTRACT

Non-occluding active noise suppression apparatus and methods are disclosed. A housing includes an inlet to admit ambient sound and an outlet to output personal sound to the ear of a user. An acoustic path and an electronic path are provided from the inlet to the outlet within the housing. For a predetermined frequency range, a phase difference between the acoustic path and the electronic path is substantially 180 degrees.

28 Claims, 8 Drawing Sheets

© 2016 DOPPLER LABS

© 2016 DOPPLER LABS

© 2016 DOPPLER LABS

© 2016 DOPPLER LABS

© 2016 DOPPLER LABS

© 2016 DOPPLER LABS

© 2016 DOPPLER LABS

© 2016 DOPPLER LABS

© 2016 DOPPLER LABS

APPARATUS AND METHOD FOR NON-OCCLUDED ACTIVE NOISE SHAPING

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims priority from provisional patent application No. 62/113,977, filed Feb. 9, 2015, titled SYSTEM AND METHOD FOR NON-OCCLUDED ACTIVE NOISE SHAPING.

BACKGROUND

1. Field

This disclosure relates to ear pieces that shape or suppress ambient sound.

2. Description of the Related Art

Active noise suppression headphones are effective at removing unwanted background noise while listening to music, taking phone calls, or resting quietly during travel or in other noisy situations. These head phones, whether in-ear, on-ear, or over-ear, universally employ the same successful recipe: passively attenuate high frequencies with structures, then actively cancel the low frequencies with analog and/or digital electronics. However, despite their relative success, these headphones suffer from the annoying and uncomfortable problem of occlusion.

Occlusion is the blocking and enclosure of the ear drum in its own pressurized volume. When this volume is relatively small, as is the case with ear buds, it exacerbates low-frequency fluctuations caused by motion and ambient pressure changes. Additional small fluctuations in pressure emitted by the ear bud's speaker and caused by imperfections in noise cancelling algorithms may add to the unpleasant vertiginous feelings many feel with occlusion.

Occlusion also comes with significant disappointments in auditory experience. Especially, sound from one's own voice does not travel by the usual air path into the ear canal but instead is conducted through bone and flesh. The voice is somewhat muted and high frequencies are attenuated, with the net result a feeling of isolation and introversion.

A further shortcoming of the traditional occluding devices is their inability to let desired sound pass un-attenuated. Because of the large broadband passive attenuation, any sound one intentionally desires to hear must be captured with an external microphone and replayed through the internal speaker. This works, but even the best electronics fail to achieve the clarity and enjoyment provided by a simply open ear canal.

Throughout this description, elements appearing in figures are assigned three-digit reference designators, where the most significant digit is the figure number where the element is introduced and the two least significant digits are specific to the element. An element that is not described in conjunction with a figure may be presumed to have the same characteristics and function as a previously-described element having the same reference designator.

DETAILED DESCRIPTION

Description of Apparatus

Simplifying for the sake of explanation, all active noise suppression systems seek to cancel sound by creating anti-sound that destructively interferes with the ambient sound in order to create silence. Typical active noise suppression ear pieces are occluding and subject to the previously discussed issues.

Figure 1:
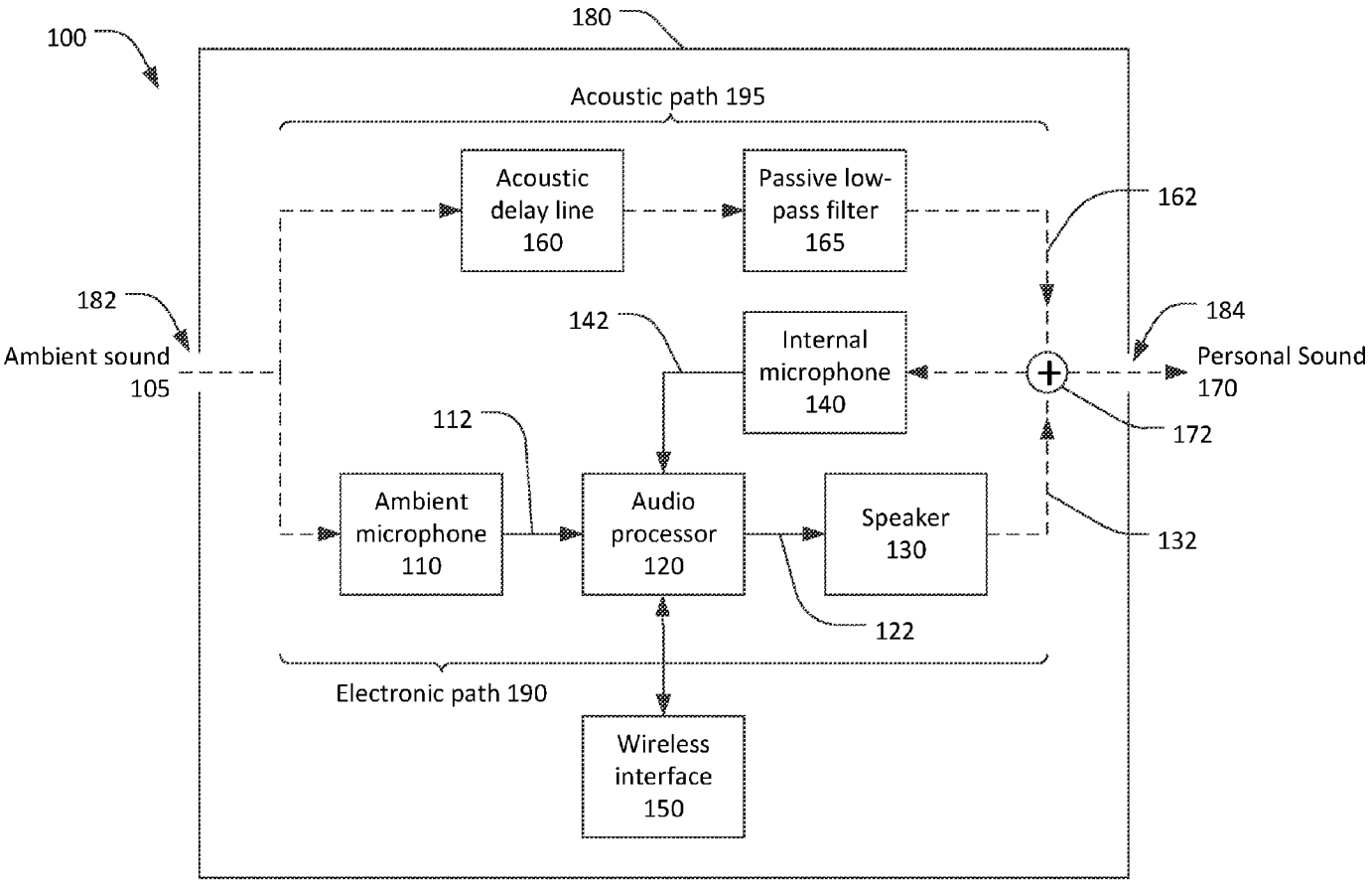
FIG. 1 is a block diagram of a non-occluding active noise shaping apparatus.

FIG. 1 is a block diagram of a non-occluding active noise suppression apparatus 100. The non-occluding active noise suppression apparatus 100 includes an ambient microphone 110, an audio processor 120, a speaker 130, and an acoustic delay line 160, an optional passive low-pass filter 165, and a battery (not shown), all of which may be contained within a housing 180. The non-occluding active noise suppression apparatus 100 may optionally include an internal microphone 140, and a wireless interface 150. The non-occluding active noise suppression apparatus 100 may receive ambient sound 105 and output personal sound 170. In this context, the term "sound" refers to acoustic waves propagating in air. "Personal sound" means sound (acoustic waves propagating in air) that has been processed, modified, or tailored in accordance with a user's personal preferences. When the non-occluding active noise suppression apparatus 100 is operating to cancel the ambient sound to the extent possible, the person sound 170 may be silence. The term "audio" refers to an electronic representation of sound, which may be an analog signal or a digital data. In FIG. 1, dashed arrows represent sound and solid arrows represent audio and other signals.

The housing 180 may be configured to interface with a user's ear by fitting in, on, or over the user's ear such that the ambient sound 105 (other than ambient sound that passes through the non-occluding active noise suppression apparatus 100) is mostly excluded from reaching the user's ear canal and the personal sound 170 generated by the non-occluding active noise suppression apparatus 100 is provided directly into the user's ear canal. The housing 180 may have at least one inlet 182 for accepting the ambient sound 105 and an outlet 184 to allow the personal sound 170 to be output into the user's outer ear canal. The housing 180 may be, for example, an earbud housing. The term "earbud" means an apparatus configured to fit, at least partially, within and be supported by a user's ear. An earbud housing typically has a portion that fits within or against the user's outer ear canal. An earbud housing may have other portions that fit within the concha or pinna of the user's ear.

The depiction in FIG. 1 of the non-occluding active noise suppression apparatus 100 as a set of functional blocks or elements does not imply any corresponding physical separation or demarcation. All or portions of one or more functional elements may be located within a common circuit device or module. Any of the functional elements may be divided between two or more circuit devices or modules. For example, all or portions of the audio processor 120 and the wireless interface 150 may be contained within a common signal processor circuit device or may be divided between two or more circuit devices.

The non-occluding active noise suppression apparatus 100 provides two paths, an acoustic path 195 and an electronic path 190, for sound to travel from the inlet 182 to the outlet 184. To prevent occlusion, the acoustic path 195 couples ambient air pressure from the inlet 182 to the outlet 184. Along the electronic path 190, a first portion of the ambient sound 105 is converted to an ambient audio signal 112 by the ambient microphone 110. The ambient audio signal 112 is processed by the audio processor 120 to provide a processed audio signal 122 that is converted into processed sound 132 by the speaker 130. Along the acoustic path 195, a second portion of the ambient sound 105 passes through the acoustic delay line 160. The delayed ambient sound 162 from the acoustic delay line 160 and the processed sound 132 from the speaker 130 acoustically combine in a mixing volume 172 proximate the outlet 184 to form the personal sound 170. The mixing volume 172 may be or include a small volume between the speaker 130 and the outlet 184 within the housing 180. The mixing volume 172 may be or include a portion of the user's ear canal (not shown). A portion of the personal sound 170 may be converted into a feedback audio signal 142 by the internal microphone 140. The feedback audio signal 142 may be provided to the audio processor 120.

The audio processor 120 may be an analog processor that processes the ambient audio signal 112 and the feedback audio signal 142, if present, to provide the processed audio signal 122. Preferably, the audio processor 120 may include one or more digital processor devices such as microcontrollers, microprocessors, digital signal processors, application specific integrated circuits (ASICs), or a system-on-a-chip (SOCs). In this case, the audio processor 120 may include circuits (e.g. preamplifiers and analog-to-digital converters) to convert the ambient audio signal 112 and the feedback audio signal 142 into ambient and feedback audio streams. In this context, the term "stream" means a sequence of digital samples. Further, the audio processor 120 may include circuits (e.g. a digital-to-analog converter and an amplifier) to convert digital processed audio data into the processed audio signal 122 to drive the speaker 130.

The audio processor 120 may include and/or be coupled to memory (not shown). The memory may store software programs, which may include an operating system, for execution by the audio processor 120. The memory may also store data for use by the audio processor 120. The data stored in the memory may include, for example, digital sound samples and intermediate results of processes performed on the ambient and feedback audio streams. The memory may include a combination of read-only memory, flash memory, and static or dynamic random access memory.

The wireless interface 150 may provide the audio processor 120 with a connection to one or more wireless networks using a limited-range wireless communications protocol such as Bluetooth®, WiFi®, ZigBee®, or other wireless personal area network protocol. The wireless interface 150 may be used to receive data such as parameters for use by the audio processor 120 in processing the ambient audio signal 112 to produce the personal audio signal 122. The wireless interface 150 may be used to receive a secondary audio feed. The wireless interface 150 may be used to export the personal audio signal 122, which is to say transmit the personal audio signal 122 to a device external to the non-occluding active noise suppression apparatus 100. The external device may then, for example, store and/or publish the personal audio stream, for example via social media.

The audio processor 120 performs noise cancellation processing, which is to say the audio processor processes the ambient audio signal 112 and the feedback audio signal 142, if present, to produce a processed audio signal 122 that causes the speaker 130 to form processed sound 132 that includes anti-sound to cancel at least a portion of the delayed ambient sound 162. The audio processor 120 may perform other processes to enhance or modify portions of the ambient sound that are not cancelled. Processes that may be performed include filtering, equalization, compression, limiting, noise reduction, echo cancellation, and/or other processes.

To cancel all or a portion of the delayed ambient sound 162, the anti-sound 132 emitted from the speaker 130 must destructively interfere. In overly simple terms, destructive interference occurs when the anti-sound 132 has a similar amplitude and opposite polarity as the delayed ambient sound 162, which is to say the anti-sound results in air motion in the opposite direction to that of the delayed ambient sound. For a single frequency, destructive interference will occur if the anti-sound 132 and the delayed ambient sound 162 are equal in amplitude and shifted in phase by 180 degrees. To cancel noise over a frequency range, it is necessary for the phase shift between the anti-sound 132 and the delayed ambient sound 162 to be substantially 180 degrees over the frequency range. In this context, "substantially 180 degrees" means "sufficiently close to 180 degrees to provide significant cancellation." For example, a ten degree phase error (i.e. a phase shift of 170 or 190 degrees) at a particular frequency allows cancellation of up to 97% of the noise power at that frequency. An eighteen degree phase error at a particular frequency allows cancellation of up to 90% of the noise power at that frequency.

A typical human ear can detect sounds having frequencies up to 20 kHz, which corresponds to a period of 50 μs. At this frequency, a ten degree phase error corresponds to a difference of only 1.5 μs between the transit time along the electronic path 190 and the transit time along the acoustic path 195. However, as previously described, active noise cancellation systems commonly combine passive filters that eliminate high frequency components of the ambient sound with active cancellation of low frequency components of the ambient sound. The frequency range over which active cancellation is employed will be referred to herein as the "operating frequency range".

Known algorithms and methods for active noise cancellation include feedforward cancellation, feedback cancellation, and hybrid cancellation. Feedforward cancellation operates based on an ambient audio signal, such as the ambient audio signal 112. Feedback cancellation operates based on a feedback audio signal such as the feedback audio signal 142. Hybrid cancellation operates based on both an ambient audio signal and a feedback audio signal. Any of these methods may be employed in the non-occluding active noise suppression apparatus 100. In any case, the electronic path 190 is operative to provide a substantially 180 degree phase shift with respect to the acoustic path 195 over the operating frequency range.

An earbud housing is typically about 10 millimeters long from an outer distal end to a proximal end in the ear canal. Sound traveling in air will transit 10 millimeters in about 30 μs. It may be difficult, if not impossible for the electronic path 190 to generate anti-sound within this short time interval. To increase the delay time along the acoustic path 195, and thus allow more time for the electronic path 190 to generate and deploy anti-sound, an acoustic delay line 160 may be incorporated into the acoustic path. The acoustic delay line 160 delays the propagation of the ambient sound along the acoustic path 195, which is to say increases the time required for the ambient sound to propagate from the inlet 182 to the outlet 184 beyond the time required for sound to travel an equivalent linear distance in air.

Figure 6A:
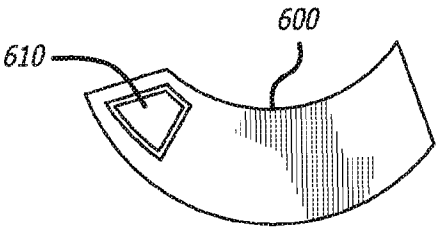
FIG. 6A, FIG. 6B, and FIG. 6C are a side view, a perspective view, and a partially sectioned view, respectively, of a serpentine acoustic delay line.
Figure 6B:
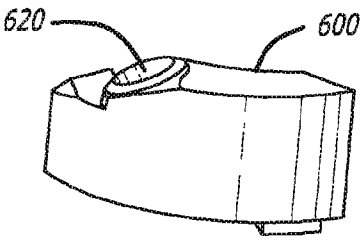
Figure 6C:
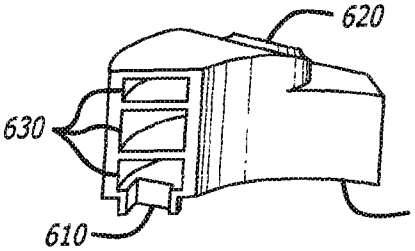

FIG. 6A, FIG. 6B, and FIG. 6C are a top view, a perspective view, and a sectioned perspective view of a serpentine acoustic tube 600 suitable for use as the acoustic delay line 160. An input port 610 to receive ambient sound is identified in FIG. 6A and FIG. 6C. FIG. 6C shows a cross section, revealing the back-and-forth serpentine passages 630 through which sound flows from the input port 610 to the output port 620. The path length from the input port 610 to the output port 620 via the passages 630 is substantially longer than the direct distance from the input port 610 to the output port 620.

The serpentine acoustic tube 600 could be fabricated by 3D printing, or could be molded in multiple pieces then glued or welded together. The serpentine acoustic tube 600 could also be fabricated in such a way that it shares its outer walls with those of the device housing 180, thereby enabling simpler construction.

An alternate or additional method to delay the ambient sound along the acoustic path 195 is to cause the ambient sound to pass through a reticulated material in which the speed of sound is slower than the speed of sound in air. In this context, "reticulated" means forming or formed like a network or a web. Suitable reticulated materials may include open-cell or closed-cell foams made of polyurethane, polyester, polystyrene, or other plastic. Other suitable reticulated materials include organic fibers like cotton, bamboo, and yarn. For example, the acoustic delay line 160 may be formed by a straight sound tube or a serpentine sound tube filled with a reticulated material in which the speed of sound is slower than the speed of sound in air.

The delay line 160 may increase the transit time along the acoustic path 195 from 50 μs to as high as 250 μs.

Referring again to FIG. 1, the acoustic path 195 may include one or more passive acoustics filters. For example, the acoustic path 195 may include a passive low-pass filter 165 to provide passive attenuation of high frequencies while transmitting low frequencies including ambient air pressure changes to eliminate occlusion. A cut-off frequency of the passive low-pass filter 165 may define an upper limit on the operating frequency range where active cancellation is employed, which is to say an upper limit on the frequency of the anti-sound generated along the electronic path 190. The passive low-pass filter 165 may be in addition to, or integrated with, the acoustic delay line 160. Structures for passive low-pass and other passive filters are described in U.S. Pat. No. 9,131,308 B2, Passive Audio Ear Filters With Multiple Filter Elements.

Even with the transit time along the acoustic path extended by the delay line 160, the elements along the electronic path 190 must be designed to minimize delay time. Most digital audio processing systems utilize sigma-delta analog-digital converters (ADCs) and digital-analog converters (DACs), both of which introduce hundreds of microseconds of delay. Although sigma-delta converters can be used to detect, predict, and cancel highly periodic low frequency sound, they are unsuited for high performance active cancellation of higher frequency, transient, and non-periodic sounds. Thus the audio processor 120 may contain ADCs and DACs that execute very fast conversions, and that operate with very high digital bus speeds. For example, a Texas Instruments ADS8864 ADC can capture and digitize an analog signal in less than 2 μs. Similarly, a Texas Instruments DAC8832 DAC can convert a digital value to an analog signal in less than 2 μs. While these components are capable of conversions at 500 kHz or higher rates, the actual audio sampling speed may be lower, such as 32 kHz or 44.1 kHz for example. Similarly, microphones, amplifiers, analog electronic filters, and algorithms executed within the audio processor must all be chosen or designed for low latency.

Figure 2:
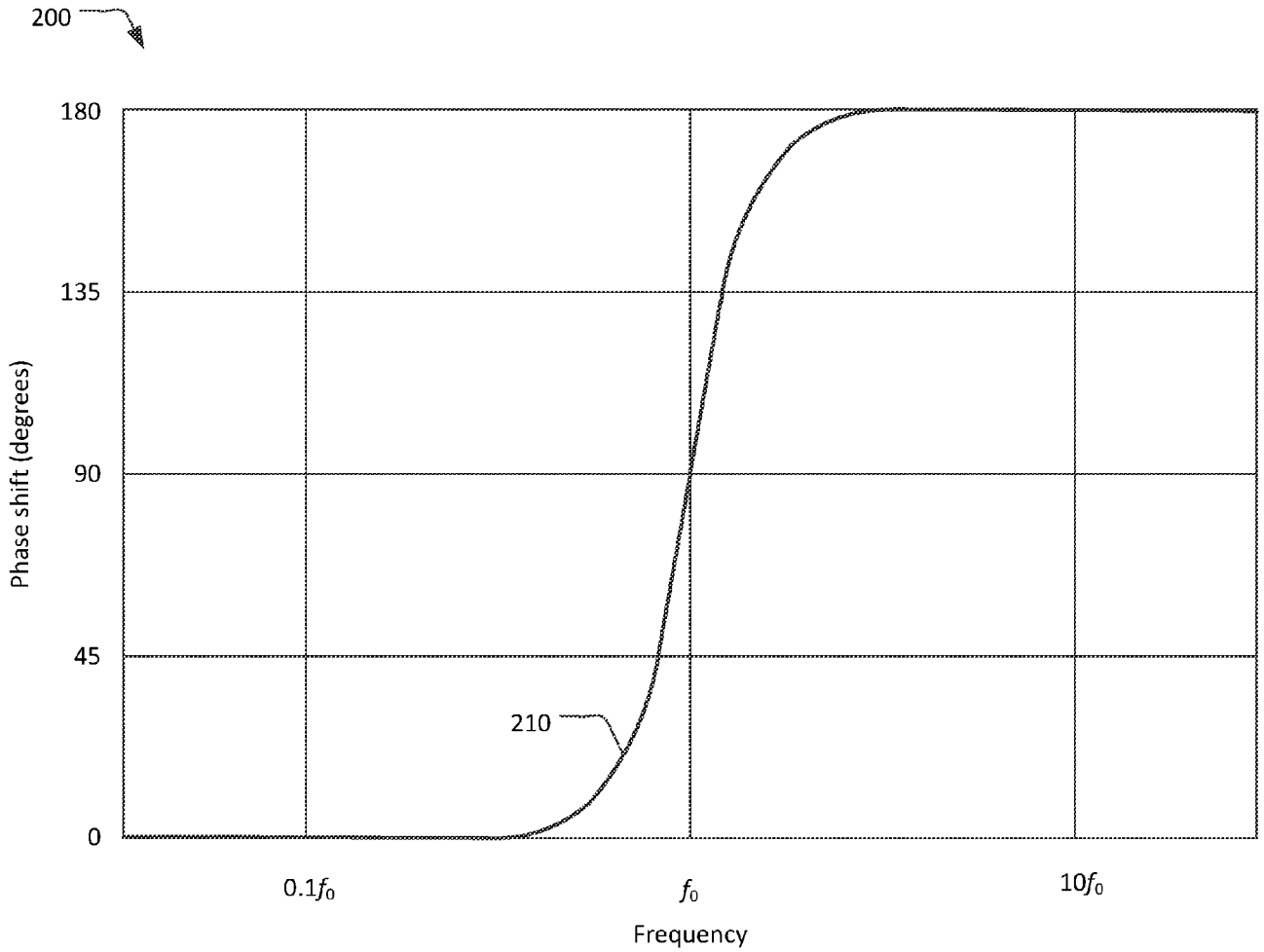
FIG. 2 is a chart showing the phase shift of a speaker as a function of frequency.

The largest single delay in generating anti-sound 132 to cancel a portion of the delayed ambient sound 162 is the speaker 130. Inherently, the delay between an electrical signal applied to a speaker and the production of sound varies with frequency. FIG. 2 shows a chart 200 including a graph 210 of the phase shift between the electrical signal applied to a speaker and the sound produced by the speaker. At low frequencies, the phase shift is small. As the frequency approaches the natural resonant frequency $f_0$ of the speaker, the phase shift approaches 90 degrees. Above $f_0$ the shift approaches 180 degrees. Increasing the natural resonant frequency of the speaker increases the frequency band over which the phase shift is low. If the resonant frequency of the speaker 130 is higher than a cut-off frequency of the passive low pass filter 165, the speaker will have low phase shift over the operating frequency range where active noise cancellation is employed.

Figure 3:
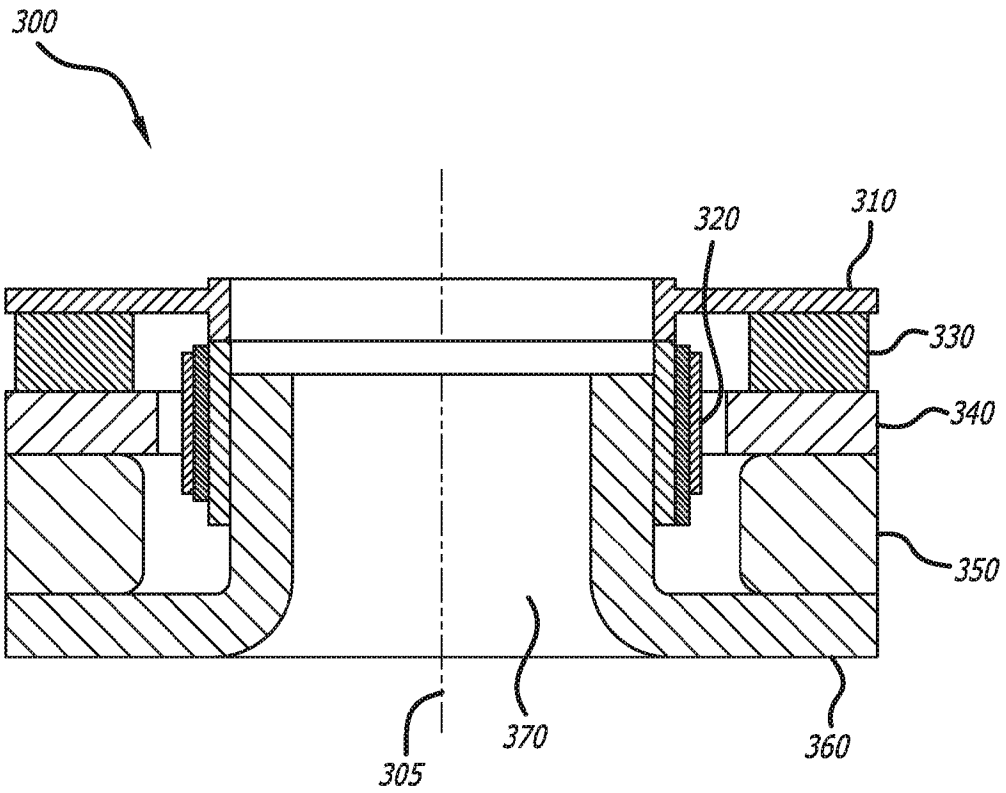
FIG. 3 is a cross-sectional schematic view of a non-occluding speaker.
Figure 4:
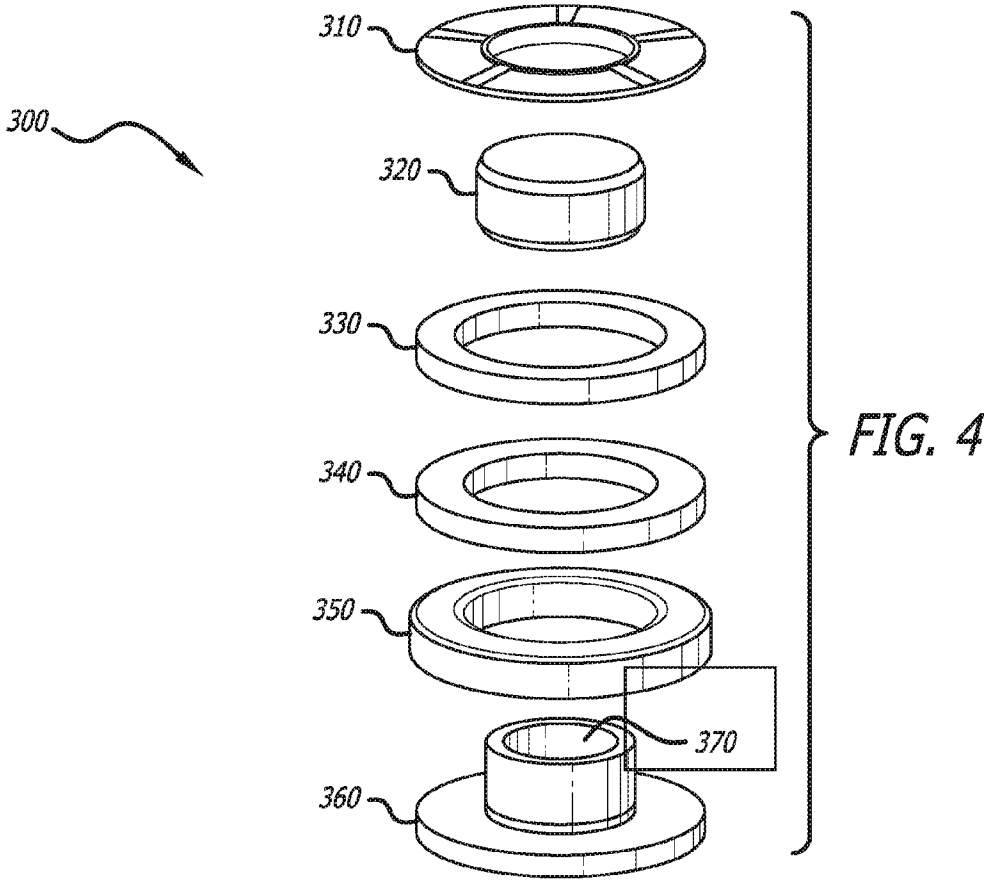
FIG. 4 is a perspective exploded view of a non-occluding speaker.
Figure 5:
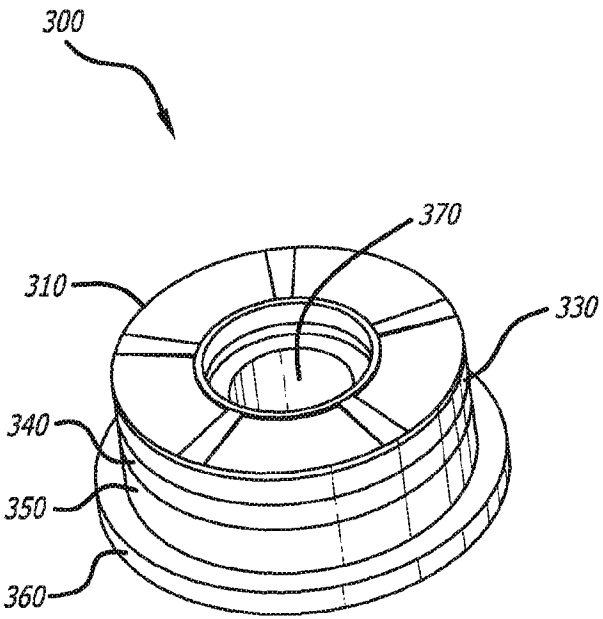
FIG. 5 is a perspective view of an assembled non-occluding speaker.

FIG. 3 is a cross-sectional schematic view of an exemplary speaker 300 suitable for use as the speaker 130 in the non-occluding active noise suppression apparatus 100. FIG. 4 is perspective exploded view of the speaker 300, and FIG. 5 is a perspective view of the assembled speaker 300. The speaker 300 may be configured to have a resonant frequency between 2 kilohertz (kHz) and 9 kHz.

The speaker 300 includes a diaphragm 310, a voice coil assembly 320, a suspension ring 330, a washer 340, a magnet 350, and a yoke 360. All of these elements may be rotationally symmetric about an axis 305. The speaker 300 may be assembled using pressure sensitive adhesive rings (not shown) between adjacent elements. The speaker 300 can be designed to have a resonant frequency between 2 kHz and 9 kHz. Further, the speaker 300 may optionally provide a central passage 370 through the yoke 360, voice coil assembly 320, and diaphragm 310. When present, the central passage may form a portion of the acoustic path 195. For example, delayed ambient sound may be introduced though the central passage 370 to combine or interfere with sound produced by movement of the diaphragm 310.

The diaphragm 310 is generally planar but may include ribs or other structure to increase rigidity. The diaphragm 310 is sufficiently rigid to move as a piston over the entire operating frequency range, avoiding "cone breakup" and resonances that occur in many other speaker diaphragms. The diaphragm 310 is suspended by an annular suspension ring 330 made from an elastic foam material, such as the PORON® 4701-30 series of very soft microcellular urethane foam materials or the PORON® 4701-40 series of soft microcellular urethane foam materials, both available from Rogers Corporation. The foam suspension ring 330 provides higher elasticity than typical speaker suspensions. The washer 340, the magnet 350, and the yoke 360 form a magnetic circuit that generates a magnetic field in the annular gap between the washer 340 and the yoke 360. The cylindrical voice coil assembly is affixed to the diaphragm and extends into the annular space between the washer 340 and the yoke 360. When driven by an electrical current, the interaction between a magnetic field produced by the voice coil 320 and a magnetic field produced by the magnetic circuit (washer 340, magnet 350 and yoke 360) causes the voice coil 320 and diaphragm 310 to move parallel to the axis 305. The assembled speaker 300 may have, for example, a diameter of 8 millimeters and a thickness of 3 millimeters.

The speaker shown in FIGS. 3-5 is an example of a high resonance frequency speaker suitable for use in the non-occluding active noise suppression apparatus 100. Other types of speakers having high resonance frequency, such as balanced armature speakers, and speakers that do not exhibit resonance, such as electrostatic speakers, may be used for the speaker 130.

Figure 7:
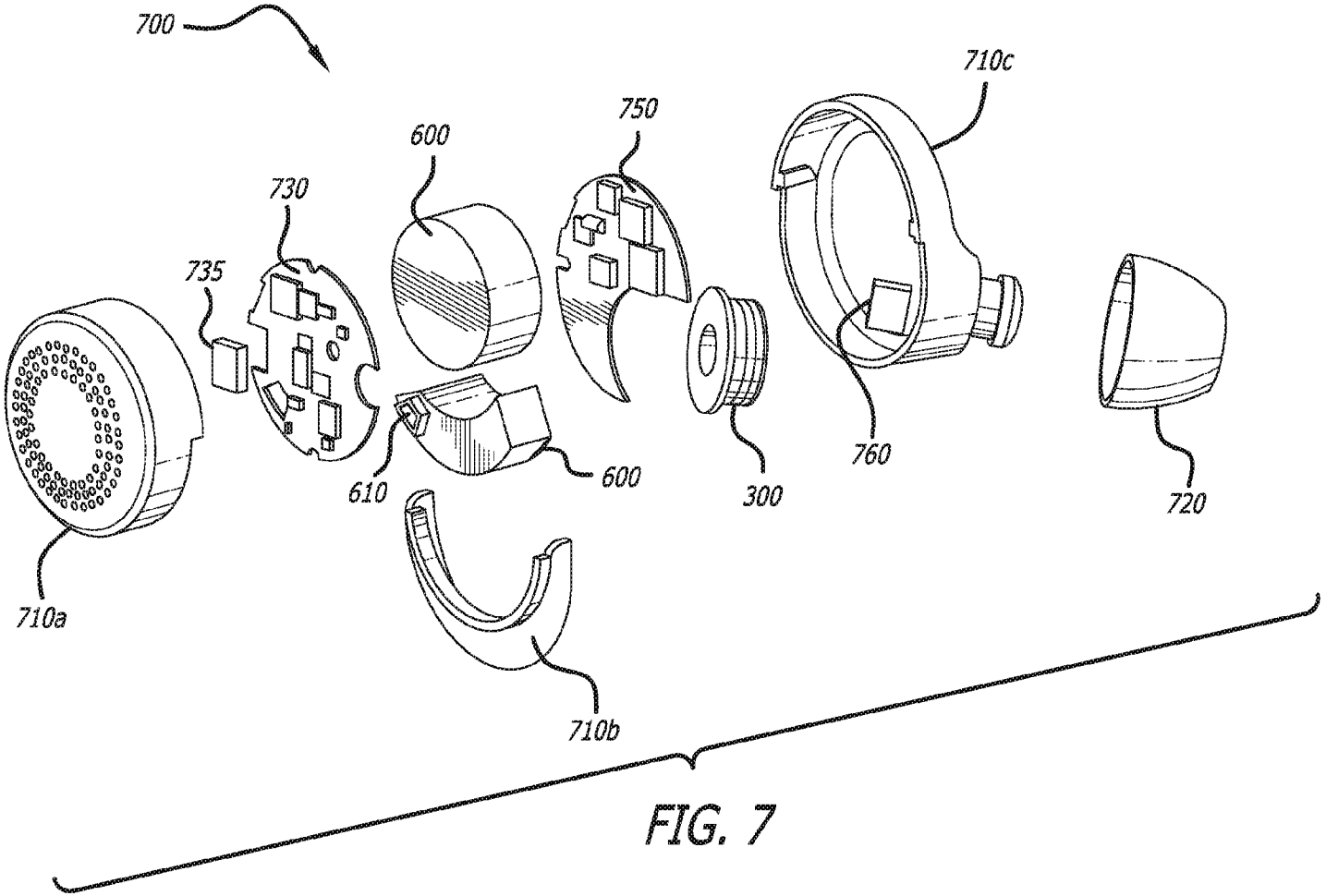
FIG. 7 is an exploded perspective view of a non-occluding active noise shaping apparatus.
Figure 8:
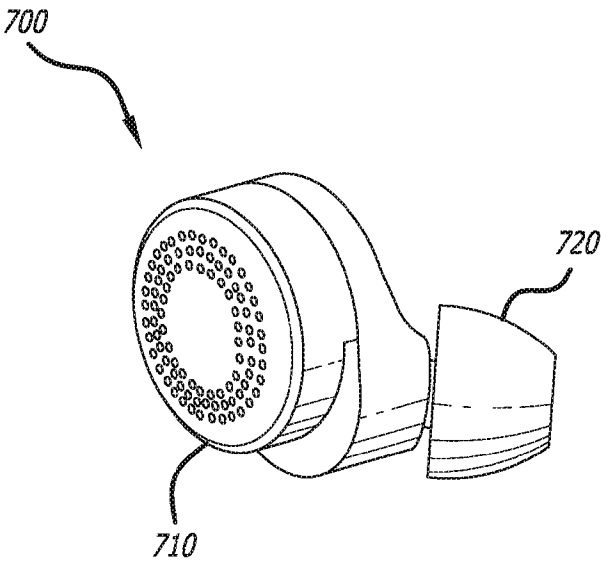
FIG. 8 is a perspective view of the non-occluding active noise shaping apparatus.

FIG. 7 shows an exploded view of an exemplary non-occluding active noise suppression ear bud 700 which utilizes the speaker 300 (shown in FIGS. 3, 4, and 5) and the serpentine acoustic tube 600 (shown in FIG. 6). The non-occluding active noise suppression ear bud 700 also includes a housing formed as an outer portion 710A, a bottom portion 710B, and an inner portion 710C; a flexible tip 720 configure to mate with a protrusion on the inner cover portion 710*c* and fit into a user's ear canal; first and second circuit cards 730, 750; an ambient microphone 735; an internal microphone 760; and a battery 740. The ambient microphone 735 and the internal microphone 760 may be connected to either the first circuit card 730 or the second circuit card 750 using wires or flexible circuits which are not shown in FIG. 7.

The outer portion of the housing 710A includes one or more perforations to admit ambient sound. Note that some of the apparent perforations visible in FIG. 7 may be decorative and not fully penetrate the outer portion of the housing 710A. A portion of the ambient sound is converted to an ambient audio signal by the ambient microphone 735. The ambient audio signal and a feedback audio signal from the internal microphone 760 are processed by an audio processor, which may be the audio processor 120, distributed between the first and second circuit cards 730, 750. The audio processor outputs a processed audio signal to drive the speaker 300.

A second portion of the ambient sound admitted through the perforations in the outer housing 710*a*, enters the distributed between the serpentine acoustic tube 600 through an aperture in the first circuit card 730. Delayed ambient sound exiting the serpentine acoustic tube 600 is coupled into a central aperture (370 in FIG. 3) to combine with sound produced by the speaker 300. Destructive interference between the delayed ambient sound the sound produced by the speaker 300 may attenuate or cancel some or all components of the delayed ambient sound. The combination of the delayed ambient sound and the sound produced by the speaker 300 may be introduced into the user's ear canal through an aperture in the flexible tip 720 (not visible).

Description of Apparatus

Figure 9:
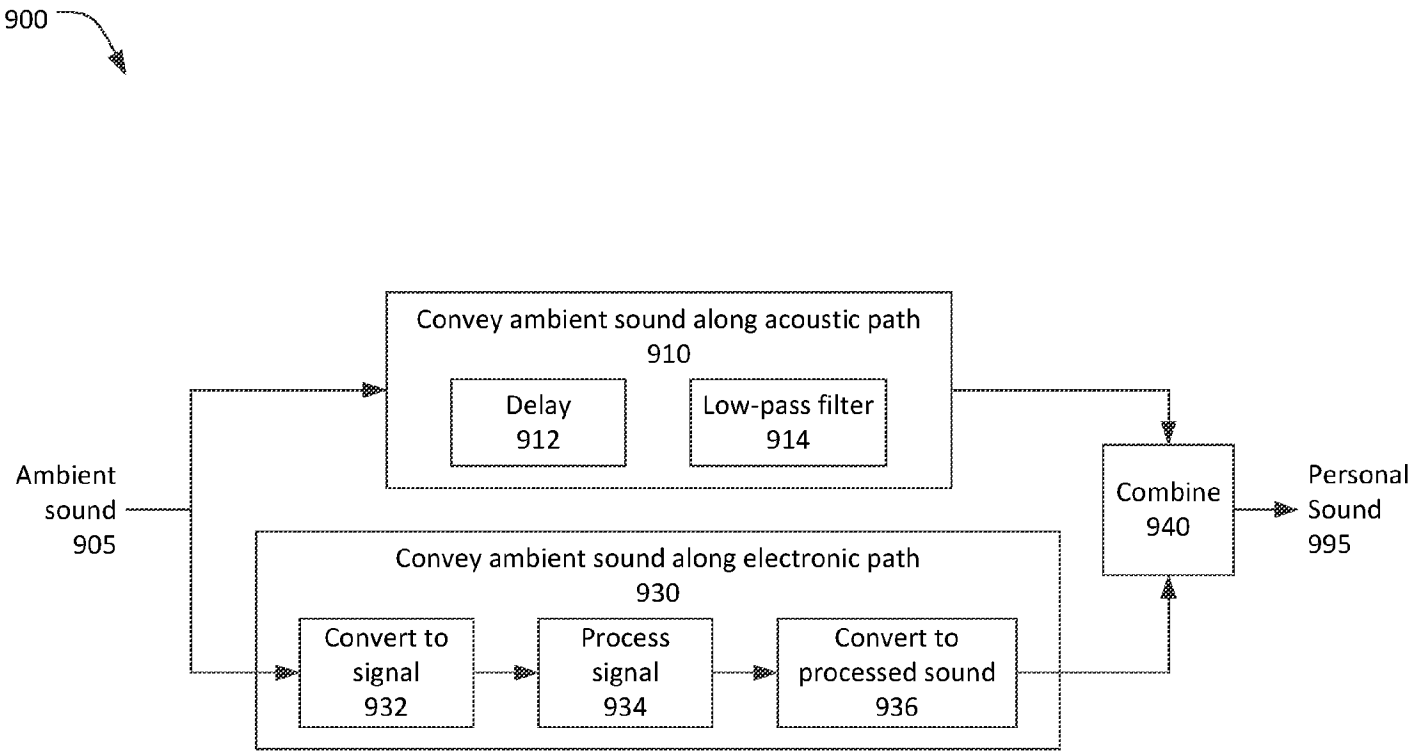
FIG. 9 is a flow chart of a process for suppressing noise.

FIG. 9 is a flow chart of a process 900 for suppressing noise. The process 900 may be performed by a noise suppression apparatus, such as the non-occluding active noise suppression apparatus 100, enclosed in a housing having an inlet to admit ambient sound and an outlet to output personal sound to the ear of a user. The housing may be, for example, an earbud housing configured to fit, at least partially, within and be supported by a user's ear.

Although shown as a flow chart for ease of explanation, the actions of the process 900 are performed continuously and concurrently. Since the actions within the process 900 are performed continuously so long as the noise suppression apparatus is operational, the process 900 does not have a convention start and end.

Ambient sound 905 may be received via the inlet. A portion of the ambient sound may be conveyed along an acoustic path at 910. Conveying the ambient sound along the acoustic path may include delaying the ambient sound at 912 and/or low-pass filtering the ambient sound at 914 as previously described.

Another portion of the ambient sound may be conveyed along an electronic path at 920. Conveying the ambient sound along the electronic path includes converting the ambient sound to a signal at 932 using a microphone. The signal from 932 is then processed at 934. The processed signal from 9343 is converted into processed sound at 936 using a speaker.

The sound from 910 (i.e. sound that has traversed the acoustic path) and the processed sound from 936 are combined or mixed at 940 to provide the personal sound 995 output via the outlet to the ear of the user.

The electronic path is configured to provide a phase difference between the process sound from 936 and the sound from 910 of substantially 180 degrees over an operating frequency range, as previously described.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of" respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A non-occluding active noise suppression apparatus, comprising:

a housing including an inlet to admit ambient sound and an outlet to output personal sound to the ear of a user;

an acoustic path from the inlet to the outlet within the housing; and an electronic path from the inlet to the outlet within the housing, wherein, for an operating frequency range, the electronic path is configured to provide a phase difference between the acoustic path and the electronic path of substantially 180 degrees.

2. The apparatus of claim 1, wherein, for the predetermined frequency range, the phase difference between the acoustic and the electronic path is within 180±10 degrees.

3. The apparatus of claim 1, wherein, for the predetermined frequency range, the phase difference between the acoustic and the electronic path is within 180±18 degrees.

4. The apparatus of claim 1, wherein the acoustic path couples ambient air pressure from the inlet to the outlet.

5. The apparatus of claim 1, wherein the acoustic path comprises an acoustic delay line.

6. The apparatus of claim 5, wherein the acoustic delay line comprises a serpentine tube.

7. The apparatus of claim 5, wherein the acoustic delay line comprises a tube filled with a material in which a speed of sound is lower than a speed of sound in air.

8. The apparatus of claim 1, wherein the acoustic path comprises a passive low-pass filter.

9. The apparatus of claim 8, where a cutoff frequency of the passive low-pass filter sets an upper limit of the operating frequency range.

10. The apparatus of claim 1, where the electronic path comprises:

a microphone to convert a portion of the ambient sound to an ambient audio signal;

an audio processor to process the ambient audio signal to provide a processed audio signal; and a speaker to convert the processed audio signal to processed sound.

11. The apparatus of claim 10, further comprising a mixing volume proximate the outlet in which the sound from the acoustic path and the processed sound combine.

12. The apparatus of claim 11, wherein the processed sound includes anti-sound to cancel at least a portion of the sound from the acoustic path over the operating frequency range.

13. The apparatus of claim 10, wherein the acoustic path comprises a passive low-pass filter, and a cutoff frequency of the passive low-pass filter is less than or equal to a resonant frequency of the speaker.

14. The active acoustic filter of claim 1, wherein:

the housing is an earbud housing configured to fit, at least partially, within and be supported by the ear of the user.

15. A method for suppressing noise, comprising:

providing a housing including an inlet to admit ambient sound and an outlet to output personal sound to the ear of a user;

conveying a portion of the ambient sound along an acoustic path within the housing from the inlet to the outlet; and conveying a portion of the ambient sound along an electronic path within the housing from the inlet to the outlet, wherein, for an operating frequency range, the electronic path is configured to provide a phase difference between the acoustic path and the electronic path of substantially 180 degrees.

16. The method of claim 15, wherein, for the predetermined frequency range, the phase difference between the acoustic and the electronic path is within 180±10 degrees.

17. The method of claim 15, wherein, for the predetermined frequency range, the phase difference between the acoustic and the electronic path is within 180±18 degrees.

18. The method of claim 15, further comprising:

coupling ambient air pressure from the inlet to the outlet along the acoustic path.

19. The method of claim 15, wherein conveying a portion of the ambient sound along an acoustic path further comprises:

delaying the ambient sound by means of the acoustic delay line.

20. The method of claim 19, wherein delaying the ambient sound comprises:

conveying the ambient sound through a serpentine tube.

21. The method of claim 19, wherein delaying the ambient sound comprises:

conveying the ambient sound through a tube filled with a material in which a speed of sound is lower than a speed of sound in air.

22. The method of claim 15, wherein conveying a portion of the ambient sound along an acoustic path further comprises:

filtering the ambient sound with a passive low-pass filter.

23. The method of claim 22, where a cutoff frequency of the passive low-pass filter sets an upper limit of the operating frequency range.

24. The method of claim 15, wherein conveying a portion of the ambient sound along an electronic path further comprises:

a microphone converting a portion of the ambient sound to an ambient audio signal;

processing the ambient audio signal to provide a processed audio signal; and a speaker converting the processed audio signal to processed sound.

25. The method of claim 24, further comprising:

combining the sound from the acoustic path and the processed sound in a mixing volume proximate the outlet.

26. The method of claim 25, wherein the processed sound includes anti-sound to cancel at least a portion of the sound from the acoustic path over the operating frequency range.

27. The method of claim 24, wherein conveying a portion of the ambient sound along an acoustic path further comprises:

filtering the ambient sound with a passive low-pass filter, wherein a cutoff frequency of the passive low-pass filter is less than or equal to a resonant frequency of the speaker.

28. The method of claim 15, wherein:

the housing is an earbud housing configured to fit, at least partially, within and be supported by the ear of the user.

* * * * *